US005185948A

United States Patent [19]

Markson

[11] Patent Number: 5,185,948

[45] Date of Patent: Feb. 16, 1993

[54] INTERACTIVE SHELF DUO SELECTOR AND SHELF MANAGEMENT SYSTEM

[75] Inventor: Richard Markson, Goshen, N.Y.

[73] Assignee: Markson Rosenthal & Company, Edgewater, N.J.

[21] Appl. No.: 694,497

[22] Filed: May 2, 1991

[51] Int. Cl.[5] ..... G09F 11/02

[52] U.S. Cl. ..... 40/506; 40/488; 248/298

[58] Field of Search ..... 40/486, 488, 491, 493, 40/506, 490, 492, 503, 504; 248/241, 298

[56] References Cited

U.S. PATENT DOCUMENTS

| | | | |
|---|---|---|---|
| 1,000,181 | 8/1911 | Larkin | 40/491 X |
| 1,812,159 | 6/1931 | Lukas | 40/491 |
| 3,111,782 | 11/1963 | Quigley | 40/491 X |
| 3,292,569 | 12/1966 | Trigilio | 40/479 X |
| 4,688,341 | 8/1987 | Castel | 40/486 X |
| 5,080,516 | 1/1992 | Ward | 40/506 X |

*Primary Examiner*—James R. Brittain
*Assistant Examiner*—Brian K. Green
*Attorney, Agent, or Firm*—Oblon, Spivak, McClelland, Maier & Neustadt

[57] ABSTRACT

A multi-sided display device for displaying selected advertising information corresponding to a particular product on display. The display device is rotatably mounted such that one of a plurality of display faces of the multi-sided display may be selected for viewing. A window opening on each display face is provided such that a customer may interactively select a variety of product information for viewing through the window opening. The device can be slidably mounted to a display shelf, peg board, floor stand, or other support surface such that it may be raised to an upright position in order to facilitate access to inventory codes or UPC codes on the end of the shelf.

10 Claims, 5 Drawing Sheets

4
10
12
14
16
16'
18
18'
22
24
26
28
30
32
34
34'
36'
38
40
40'
42
42'
44
44'
46
46'
48
48'
50
50'

INTERACTIVE SHELF DUO SELECTOR AND SHELF MANAGEMENT SYSTEM

BACKGROUND OF THE INVENTION

1. Field of the Invention

The present invention relates to an advertising display device. More particularly, the present invention relates to a multi-sided selective advertising display which is both rotatable in order to display a plurality of display faces and movable to a raised position to permit the reading of bar code and inventory information on a display shelf on which the display device is mounted.

2. Description of the Related Art

Store displays are known in which a billboard type display is used to advertise an item. Such billboard type displays may be mounted either directly on the front edge of a display shelf or other support for the advertised item, or they may be mounted extending perpendicularly from the display shelf or support. These type displays include only one face for advertising the particular item currently on display. When a new item is placed on display the billboard must be inconveniently removed and replaced by a different billboard. Additionally, in order for a store clerk to scan inventory or UPC codes typically affixed to the front edge of the display shelf, the entire billboard must be removed and then replaced when scanning is completed. Furthermore, such displays are typically static and therefore limited in the amount of information available to a potential purchaser of a displayed item.

SUMMARY OF THE INVENTION

Accordingly, one object of this invention is to provide a novel display device which eliminates the need to change an advertising billboard every time a display item is changed.

It is a further object of this invention to provide a novel display device which does not have to be removed from a display shelf in order to enable inventory or UPC codes to be read.

It is also an object of this invention to provide a display device wherein a customer may interact with the display to select information related to a product on display.

To achieve these and other objects, the present invention is directed to a display device with multiple display faces having different advertising indicia on each face, and which is rotatably mounted to a display shelf or other support for the display in order that any one of the multiple display faces may be viewed. The display is mounted to permit movement of the display from a display position upward to a raised position to enable reading of UPC and inventory codes mounted on the shelf edge, and may be fixed in the raised position when reading the codes. Additionally, each display face includes a window opening through which selected information concerning a displayed item may be viewed. To this end, a slide bar provided with various product information thereon is situated behind the window opening and may be moved by the customer to a selected position in which particular product information is displayed in the window opening. The product information provided on the slide bar may be, for example, answers to questions pertaining to a displayed product.

The display device may be rotatably mounted to a front edge of a display shelf with two support brackets, or alternatively, the display device may be rotatably mounted or clipped to a price channel, or hung from a peg board, slot board or existing floor stand. When mounted to a display shelf, each end of the display is mounted by a bracket which includes a horizontal planar surface for attaching the bracket to the shelf, a vertical planar section extending perpendicular to the shelf for segmenting a product on the shelf which the display unit fronts, and a slotted vertical planar portion extending away from the shelf. Each end of the display device is supported in a slotted portion such that the display is rotatable within the slotted portion in order that each of the multiple display faces may be viewed. The display device is also slidable within the slotted portion to a raised position and may be fixed at the raised position to conveniently access the edge of the shelf for reading inventory or UPC codes marked thereon.

In a preferred embodiment, the display device includes a triangular tube which is rotatably mounted to a store shelf. Preferably, two faces of the triangular tube are utilized to display advertising indicia, such as a product logo, and a third face indicates a store identification number. However, the third face may also indicate additional advertising indicia. Each of the display faces is also provided with first and second openings therein which, in conjunction with a V-shaped slide-bar, enable selective viewing of product information. The V-shaped slide-bar is shorter in length than the triangular tube and slidably situated within the triangular tube such that each side of the V-shaped slide-bar is adjacent a corresponding display face. Information relating to a product on display is affixed to each side of the V-shaped slide-bar such that this information is viewable through the first opening in each of the display faces. A knob connected to each side of the V-shaped slide-bar and protruding through the second opening allows a customer to interactively move the V-shaped slide-bar within the triangular tube in order to position the slide-bar for viewing selected information in the first opening. Of course, it will be recognized that the display device is not limited to a triangular tube shape, but may also be, e.g., a two-sided or four-sided tubular member. In the case of a two-sided or four-sided display device, the slide bar will be appropriately shaped to correspond to the shape of the tubular member.

In another embodiment of the invention, selective display of information is provided by means of a planar slide-bar with various product information thereon in conjunction with a face plate with advertising indicia thereon. Each face plate is mounted to a display face of the display device and includes a first and second opening. A planar slide-bar is slidably interposed between each face plate and each display face of the display device. Each slide bar includes a projecting surface which extends through the first opening in the face plate such that a customer may interactively move the slide-bar to display selected product information in the second opening in the face plate.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
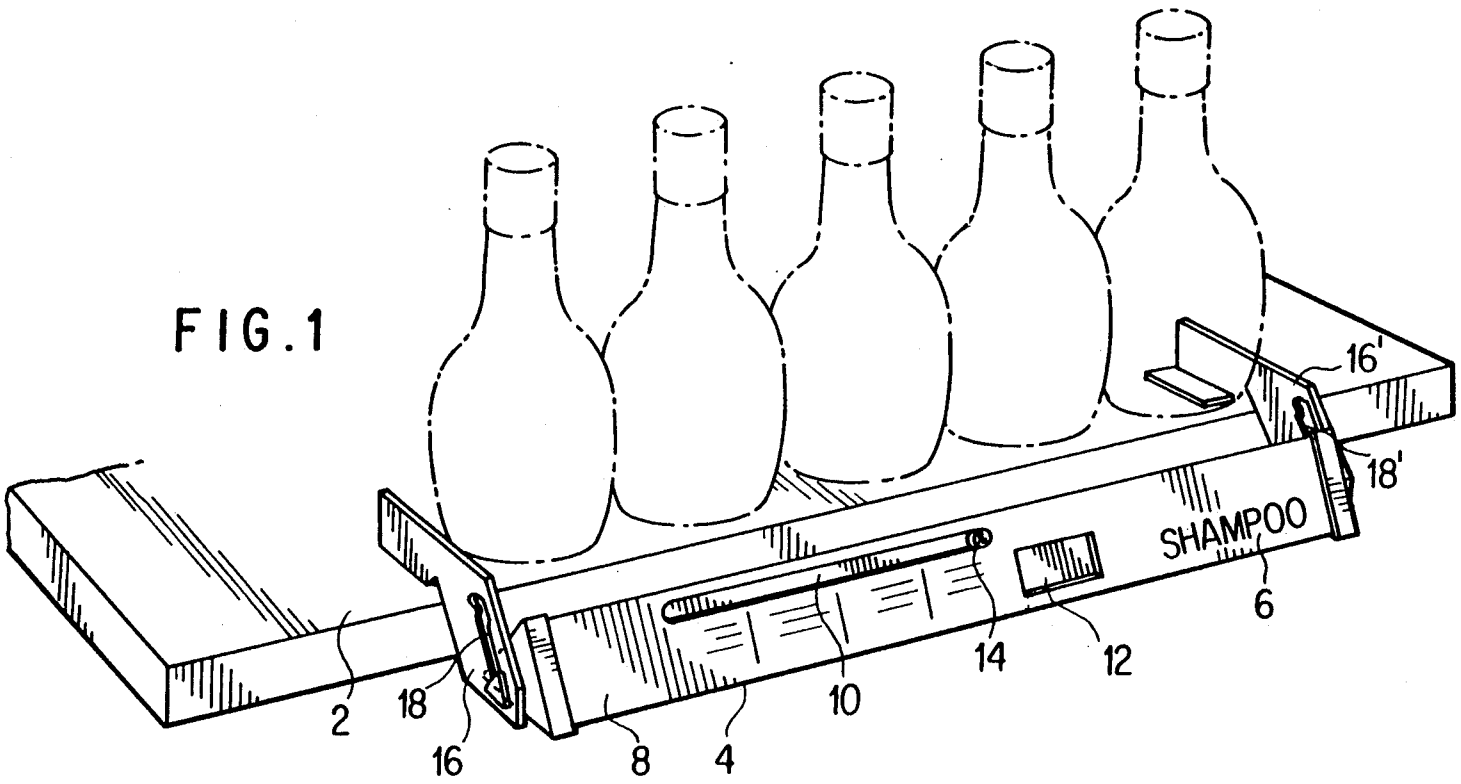
FIG. 1 is front and left side perspective view of the display device employed on a display shelf according to the invention.

Referring now to the drawings, wherein like reference numerals designate identical or corresponding parts throughout the several views, and more particularly to FIG. 1 thereof, a front and left side perspective view of the display device as employed on a display shelf 2 according to the present invention is illustrated. The display device includes a multi-sided display body 4 which is preferably an elongated triangular tube shape. However, the display body is not limited to a triangular tube shape, but may also be a two-sided or four-sided tubular member. Advertising indicia which correspond to respective display items may be placed on each display face of the display body 4, in a manner similar to the indicia 6 shown on display face 8, such that the indicia 6 is viewable by a customer at the display. The indicia displayed on each display face may include, for example, a product logo, a product name, SKU, flavor information or any combination of the aforementioned information. Indicia corresponding to an item different from an item currently on display are placed on other display faces (not shown) such that upon rotating the display the indicia corresponding to the different item will be viewable by the customer, as will be more fully described below. Each display face includes a first opening 10 and a second opening 12, which are preferably a slotted opening and a rectangular shaped opening, respectively. The display body 4 includes a sliding member (not shown) which is slidably mounted within the display body 4 and has information concerning a displayed product provided thereon. The sliding member moves behind each display face such that the product information provided on the sliding member is viewable through the second opening 12. The sliding member may be moved via a knob 14 connected to the sliding member and protruding through the first opening 10, such that a customer may interactively select the particular information provided on the sliding member which he or she desires to view through the second opening 12. By moving the knob 14 to different positions within the first opening 10 the various product information on the sliding member is revealed through the second opening 12. Questions concerning a consumers' product needs may be provided on each display face in an area below the first opening 10, and answers to the questions may be provided on the sliding member such that when knob 14 is moved to a position corresponding to a particular question provided on the display face, the answer to that question appears in the second opening 12. The display body 4 is mounted to the display shelf 2 by brackets 16, 16′ such that it is aligned parallel to the front edge of the display shelf 2 and rests in a display position directly in front of the front edge of the shelf 2. Each end of the display body 4 is supported in slots 18, 18′ within the brackets 16, 16′, respectively. The display body 4 is mounted in the slots 18, 18′ in a manner which permits the display body 4 to be rotated and also moved to a raised position while still supported in the brackets 16, 16′, as will be more fully described in connection with FIG. 2.

Figure 2:
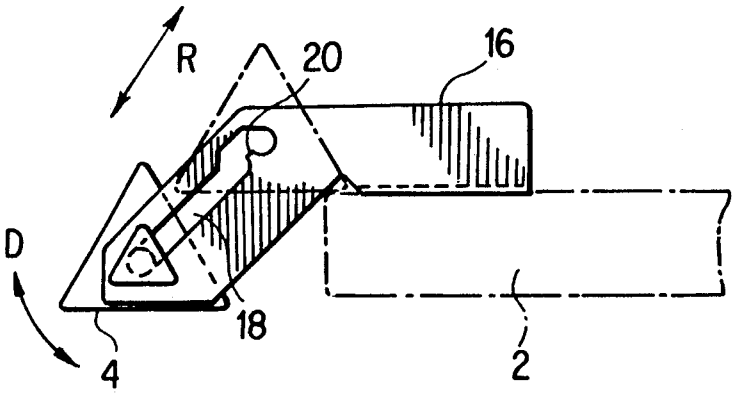
FIG. 2 is a side view illustrating the operation of the display according to the invention.

FIG. 2 illustrates an aspect of the invention whereby the display body 4 may be raised and/or rotated. The display body 4 is normally supported by brackets 16, 16′ in a display position, depicted by position D in FIG. 2, wherein the display body 4 is positioned parallel to and directly in front of the front edge of the display shelf 2. Should a clerk need to scan inventory or UPC codes located on the front edge of the shelf 2, the display body 4 is simply moved upward, as indicated by the arrow, within slots 18, 18′ to a raised position, depicted by position R in FIG. 2, revealing the front edge of the display shelf 2. The display body 4 may be fixed in the raised position by a locking device 20 which is provided in the upper portion of the slots 18, 18′ as will be more fully described below in connection with the description of the brackets 16, 16′. When a new item is placed on display, the display body 4 may be rotated, as indicated by the arrow, within support slots 18, 18′ without removing the display from the shelf, such that a different display face having advertising indicia and information which corresponds to the newly displayed item may be viewed.

Figure 3:
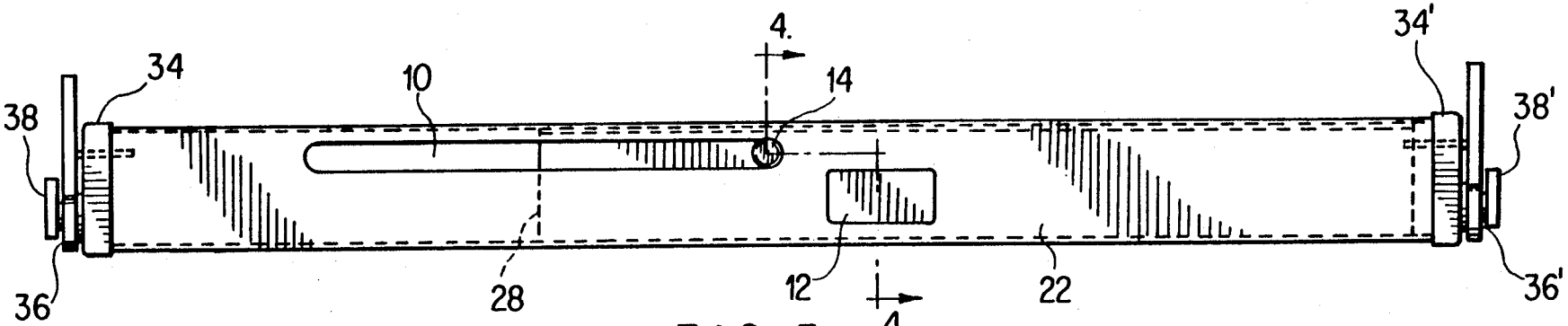
FIG. 3 illustrates a front view of the display device according to the invention.
Figure 4:
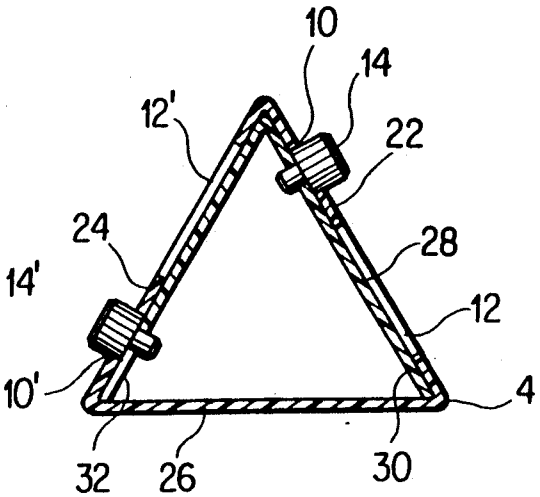
FIG. 4 illustrates a side view of the embodiment of the invention utilizing a V-shaped slide-bar.
Figures 5, 6:
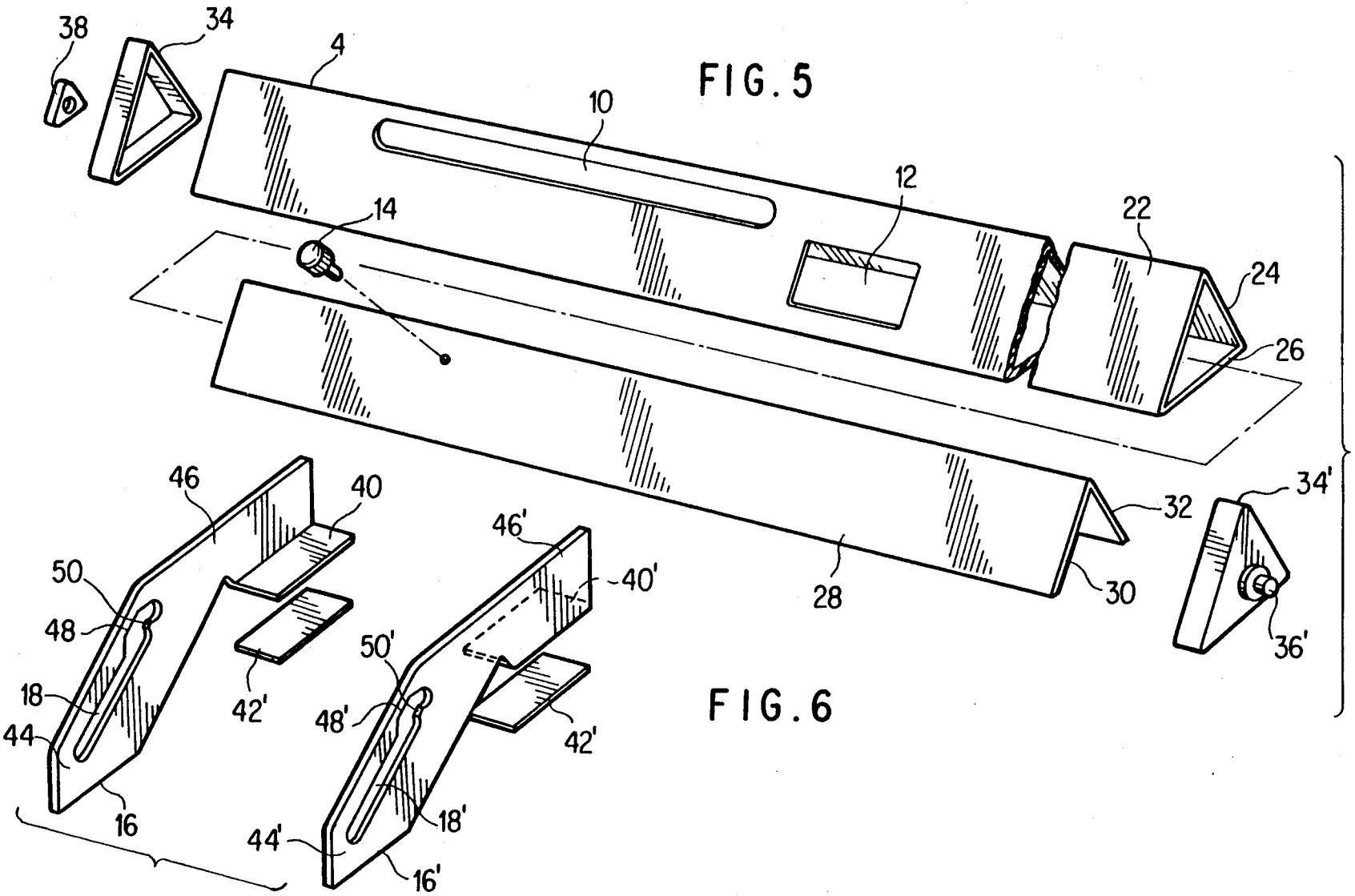
FIG. 5 illustrates an embodiment of the invention utilizing a V-shaped slide-bar.
FIG. 6 illustrates a pair of brackets for rotatably supporting the display device.

The preferred embodiment of the display device according to the present invention is shown in FIGS. 3–5 which illustrate front, side and perspective views of the display device, respectively, wherein like reference numerals identify identical or corresponding parts. Each of the sides 22, 24 and 26 of the display body 4 is preferably of equal dimension, and together the sides form an elongated equilateral triangular tube. Two sides 22, 24 of the display may be utilized as display faces for displaying advertising information thereon while a third side 26 may have a store identification code thereon. Alternatively, all three sides 22, 24 and 26 of the triangular tube may be utilized as display faces. The elongated triangular body 4 is preferably formed of lightweight plastic or other suitable material via an extrusion process. In the preferred embodiment, two openings, preferably a slotted opening 10 and a rectangular shaped window opening 12 are routed in each of the display faces 22, 24 of triangular tube body 4. The slotted opening 10 provides for movement of a V-shaped slide-bar 28 which is slidably situated within the triangular display body 4. The rectangular shaped window opening 12 provides for viewing of information on the V-shaped slide bar 28. The V-shaped slide-bar 28 is shorter in length than the triangular tube body 4 and is slidable within the triangular tube body 4 such that each of two sides 30, 32 of the V-shaped slide-bar 28 move within the triangular tube body 4 adjacent the two display faces 22, 24, respectively. Each side 30, 32 of the V-shaped slide bar 28 is viewable through a corresponding rectangular opening 12, 12′, as seen in FIG. 4. The V-shaped slide-bar 28 is preferably formed of lightweight plastic or other suitable material by an extrusion process. Information corresponding to different display items is provided on respective sides 30, 32 of the V-shaped slide-bar 28 such that when the display body 4 is rotated a different rectangular window opening and therefore different product information may be displayed. Two knobs 14, 14' are connected to each side 30, 32, respectively, of the V-shaped slide-bar 28. Each knob 14, 14' extends through a corresponding slotted opening 10, 10', respectively. The knobs 14, 14' connected to respective sides 30, 32 of the V-shaped slide bar 28 allow a customer to interact with the display by moving the V-shaped slide-bar 28 to a selected position within the triangular tube body 4. The position of a respective knob 14, 14' within slotted openings 10, 10' determines which of the various information mounted on the sides of the V-shaped slide-bar 28 will be displayed through respective rectangular openings 12, 12'. Thus, a customer may interactively select particular information concerning a product which is of interest to him or her. In the preferred embodiment, questions concerning a customer's needs with respect to a displayed product are provided on the display faces 22, 24 in an area below the slotted openings 10, 10'. The answers to these questions are provided on the sides 30, 32 of the V-shaped member such that by moving a respective knob 14, 14' to a position within a slotted opening 10, 10' corresponding to a particular question provided on the display faces, the answer to that question will appear in a respective window opening 12, 12'.

Each end of the triangular tube body 4 is sealed by an end cap 34, 34', respectively, which is pressure fit to the end of the triangular tube body 4. End pins 36, 36' extend from each of the end caps 34, 34', respectively, and ride in the slots 18, 18' of support brackets 16, 16', respectively. End locks 38, 38' are fitted over the portion of end pins 36, 36' which extend through the slotted portion 18, 18' of the brackets 16, 16' in order to secure the ends of triangular tube body 4 to the brackets 16, 16'.

FIG. 6 illustrates a pair of brackets 16, 16' for mounting the display body 4 according to the present invention. Each bracket 16, 16' supports a respective end of the display body 4. Each bracket attaches to a display shelf or any other type of support surface by means of horizontal planar projecting surfaces 40, 40' which rest flush with a display shelf 2. The horizontal planar projecting surfaces 40, 40' allow the brackets 16, 16' to be secured to the shelf 2 using any suitable type of fastening means, such as foam tape 42, 42'. It will be recognized that other suitable means for attaching the brackets 16, 16' to a support surface exist, such as spring clips, clamp units, etc., as will be more fully described in connection with FIG. 8. Each bracket 16, 16' includes a vertical planar portion 46, 46' extending perpendicular to each horizontal planar portion 40, 40', respectively and also perpendicular to the display shelf 2. This portion of the bracket conveniently segments an article being displayed on the particular portion of the display shelf which is fronted by the display device. The body 4 of the display is supported by vertical planar portions 44, 44' of the brackets 16, 16', respectively, which extend away from the display shelf 2. The vertical planar portions 44, 44' extending away from the display shelf include slotted portions 18, 18', respectively, wherein the end pins 36, 36' of the display body are placed such that the display can be rotated while supported in the slots 18, 18', or moved to a raised position by sliding the display upwards in the slots 18, 18'. Raising the display allows one to view the end portion of a display shelf such that inventory codes or UPC codes may be read therefrom. In a preferred embodiment, each of brackets 16, 16' also include a locking device 48, 48' respectively, for fixing the display body in the raised position such that the display body does not have to be manually held while accessing UPC or inventory codes. Each locking device preferably comprises a stepped portion 50, 50' at the upper portion of slots 18, 18' whereby the end pins 36, 36' of the display body are supported by the stepped portions 50, 50' such that the display remains in the raised position.

Figure 7:
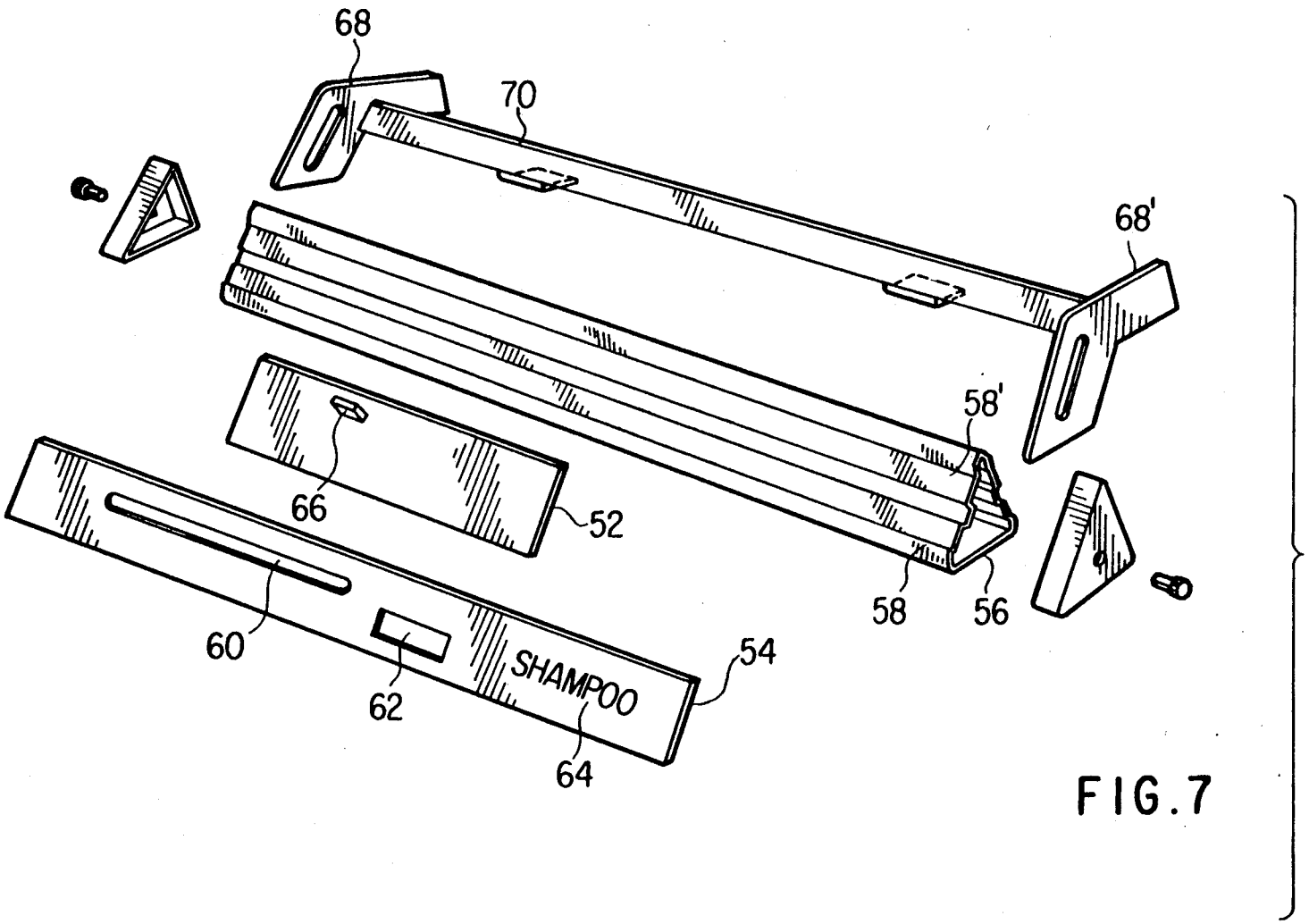
FIG. 7 illustrates an embodiment of the invention utilizing a planar slide-bar.

Another embodiment of the invention, in which each of the display faces includes a planar slide-bar 52 with advertising information thereon and a face plate 54 is illustrated in FIG. 7. In this embodiment, the triangular tube body 56 includes channels 58, 58' on each of the display face sides for slidably mounting the planar slide-bar 52 within the channels 58, 58'. The triangular channeled body 56 is preferably a lightweight plastic formed by an extrusion process. Face plate 54 includes two openings which are preferably a slotted opening 60 and a rectangular opening 62, and is mounted on the triangular channeled body 56 with the planar slide-bar 52 interposed therebetween. Face plate 54 may include an advertising logo or any other type of indicia 64 thereon which corresponds to a displayed item. A projecting portion 66 of the planar slide-bar 52 protrudes through the slotted opening 60 of face plate 54 such that a customer may interactively move the projecting portion 66 to move the planar slide-bar 52 to a position for viewing selected information on the planar slide-bar 52 which appears in rectangular window opening 62. The display according to this embodiment may also be rotatably and raisably mounted with support brackets 68, 68' in the manner described previously with respect to the preferred embodiment. Additionally, a bar 70 extending between brackets 68, 68' interconnects these brackets and serves as a front rail to contain or organize a product on a display shelf.

Figure 8A:
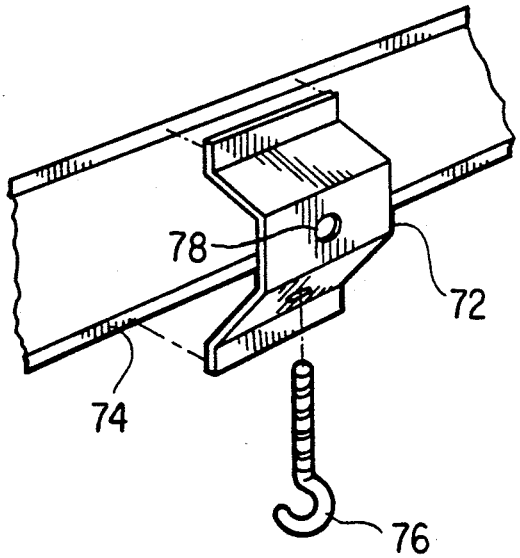
FIGS. 8*a*–8*c* illustrate various alternative means for fastening the display device to a display support.
Figure 8B:
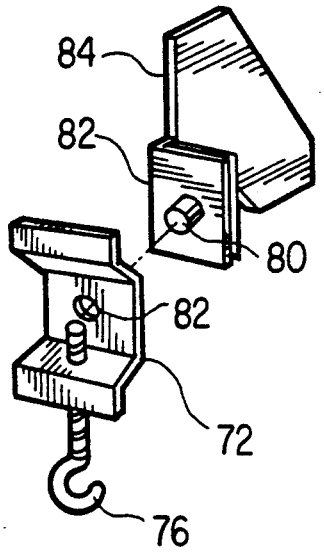
Figure 8C:
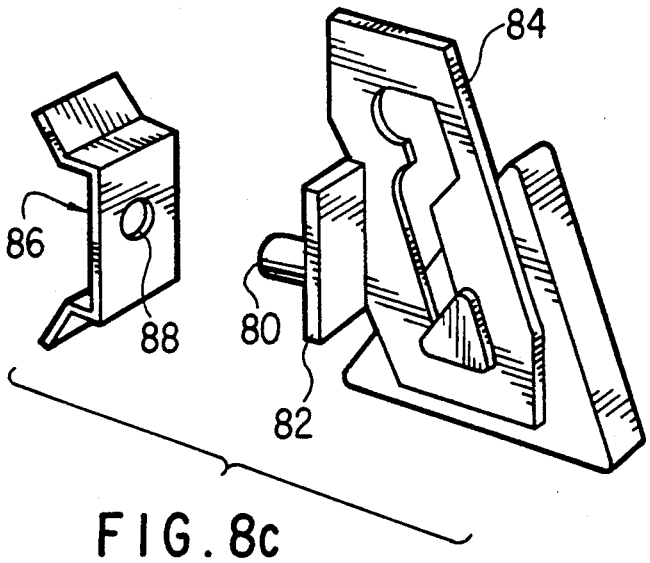

FIGS. 8*a*–8*c* illustrate alternative means for fastening brackets which support a display device to a support surface. FIG. 8 depicts a clamp unit 72 for fastening a bracket to a support surface. The clamp unit 72 fits into a price channel 74 located on the front edge of a display shelf and includes a thumbscrew 76 for expanding the clamp so that it tightens in the price channel 74. The clamp unit 72 includes a circular opening 78 which cooperates with a cylindrical projecting surface 80 formed on a vertical planar surface 82 of a molded bracket 84 in order to secure the bracket 84 to the clamp unit 72. FIG. 8*c* shows a spring clip 86 for fastening a bracket. The spring clip 86 may be compressed to securely fit into the price channel 74 and includes a circular opening 88 which cooperates with the cylindrical projecting surface 80 of the vertical planar portion 82 of bracket 84 in order to secure the bracket 84 to the spring clip 86. Of course it will be recognized that any suitable alternative means of fastening a bracket to a surface may be utilized.

The principal preferred embodiments, and modes of operation of the display device in accordance with the present invention have been described in the foregoing specification with respect to the preferred embodiment. Obviously, additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A display device comprising:

an elongated triangular tube for displaying indicia on a plurality of display faces formed on said elongated triangular tube;

support means for rotatably supporting said elongated triangular tube on a display shelf, said support means comprising means for permitting the movement of said elongated triangular tube from a display positioned to a raised portion;

first and second openings formed on at least two of said plurality of display faces on said elongated triangular tube; and a V-shaped member which is shorter in length than said triangular tube and slidably mounted within said triangular tube, said V-shaped member having a plurality of indicia thereon such that said V-shaped member may be moved within said triangular tube to display a selected one of said plurality of indicia through each of said second openings formed on said at least two of said plurality of display faces on said triangular tube.

2. The display device as defined in claim 1, wherein said support means comprises first and second brackets, each of said first and second brackets comprising elongate slots which define said means for permitting said movement of said triangular tube from said display position to said raised position.

3. The display device as defined in claim 2, wherein said means for permitting the movement of said triangular tube comprises fixing means formed on a portion of said elongate slot corresponding to said raised position for fixing said triangular tube in said raised position.

4. The display device as defined by claim 3, wherein said fixing means defines a curved portion formed on a portion of said elongate slot corresponding to said raised position for enabling said fixing of said triangular tube at said raised position.

5. The display device as defined in claim 1, wherein said triangular tube further comprises a plurality of knobs connected to said V-shaped member, wherein each of said plurality of knobs extends through a corresponding one of said first openings such that each of said plurality of knobs may be moved within said corresponding first openings to select one of said plurality of indicia to be displayed through each of said second openings.

6. A display device comprising:

an elongated triangular tube for displaying indicia on a plurality of display faces formed on said elongated triangular tube; and support means for rotatably supporting said elongated triangular tube on a display shelf, said support means comprising means for permitting the movement of said elongated triangular tube from a display position to a raised position; wherein said support means further comprises:

a first and a second bracket for mounting a first and a second end, respectively, of said triangular tube on said display shelf wherein each of said brackets comprises a horizontal planar surface for securing said bracket to said display shelf, a first vertical planar surface extending perpendicular from said horizontal planar surface for segmenting a product being displayed, and a second vertical planar surface extending at an angle from said first vertical planar surface and including an elongate slot for securing an end of said triangular tube, wherein said triangular tube is slidable to said raised position within said elongate slot.

7. The display device as defined by claim 6, wherein said support means further comprises fixing means for fixing said triangular tube in said raised position.

8. A display device comprising:

a rotatable multi-sided means for selectively displaying information on a plurality of sides of said multi-sided means, wherein said multi-sided means comprises a plurality of display faces including a slotted opening and a rectangular opening formed on said display faces, and a V-shaped member with a plurality of indicia thereon slidably situated inside said multi-sided means and shorter in length than said multi-sided means;

a plurality of knobs connected to said V-shaped member and each of said knobs protruding through a corresponding one of said slotted openings and movable within said slotted openings to slide said V-shaped member within said multi-sided means in order to selectively display one of said plurality of indicia thereon in a corresponding rectangular opening;

means for rotatably mounting said multi-sided means to a display shelf such that said multi-sided means is rotatable to display a selected side of said multi-sided means; and means for permitting the movement of said multi-sided means from a display position to a raised position, wherein said means for permitting the movement of said multi-sided means comprises fixing means for fixing said multi-sided means in said raised position.

9. The display device as defined by claim 8, wherein said means for rotatably mounting comprises a first and a second bracket for mounting a first and a second end, respectively, of said multi-sided means on said display shelf, wherein each of said brackets comprises a horizontal planar surface for securing said bracket to said display shelf, a first vertical surface perpendicular to said horizontal planar surface for segmenting a product on display, and a second vertical planar surface extending at an angle from said first vertical surface for securing an end of said multi-sided means.

10. A display device comprising:

a triangular tube including advertising indicia on a plurality of sides of said triangular tube and a slotted opening and a corresponding rectangular opening formed on each of at least two sides of said triangular tube;

a V-shaped member shorter in length than said triangular tube and slidably mounted inside said triangular tube wherein a plurality of different indicia are formed on each surface of said V-shaped member;

a plurality of knobs connected to said V-shaped member and protruding through each said slotted openings of said triangular tube for sliding said V-shaped member within said triangular tube such that a selected one of said plurality of indicia on said V-shaped member is displayed through each said corresponding rectangular opening according to a position of each said knob within each said slotted opening;

a first and a second bracket for rotatably mounting a first and a second end, respectively, of said triangular tube to a display surface such that a selected one of said plurality of sides of said triangular tube may be viewed, wherein each bracket comprises a horizontal planar projecting surface for attaching said bracket to said display surface, a first vertical planar surface perpendicular to said horizontal surface, and a second vertical planar surface projecting at an angle to said first vertical planar surface for rotatably attaching an end of said triangular tube to said bracket, wherein each of said brackets comprises an elongate slot in said second vertical planar surface of said brackets such that each end of said triangular tube is mounted in said elongate slot and said triangular tube is slidable from a display position to a raised position within said slot; and means for fixing said triangular tube in said raised position.

* * * * *